US006280262B1

(12) United States Patent
Tanaka

(10) Patent No.: US 6,280,262 B1
(45) Date of Patent: Aug. 28, 2001

(54) CONNECTOR

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/456,966

(22) Filed: Dec. 7, 1999

(30) Foreign Application Priority Data

Dec. 8, 1998 (JP) ..... 10-348748
Jun. 24, 1999 (JP) ..... 11-178745

(51) Int. Cl.[7] ..... H01R 13/514
(52) U.S. Cl. ..... 439/752; 439/595
(58) Field of Search ..... 439/752, 459, 439/456, 460, 595

(56) References Cited

U.S. PATENT DOCUMENTS

| | | | | |
|---|---|---|---|---|
| 5,033,976 | | 7/1991 | Sarian et al. | 439/467 |
| 5,183,418 | * | 2/1993 | Yamanashi et al. | 439/752 |
| 5,277,619 | | 1/1994 | Yamamoto | 439/469 |
| 5,516,984 | | 5/1996 | Soes et al. | 474/65 R |
| 5,575,681 | | 11/1996 | Muzslay et al. | 439/469 |
| 5,616,045 | | 4/1997 | Gauker | 439/352 |
| 5,651,692 | * | 7/1997 | Hatagishi | 439/459 |
| 5,716,242 | | 2/1998 | Myer | 439/748 |

FOREIGN PATENT DOCUMENTS

| | | |
|---|---|---|
| 0 596 707 | 5/1994 | (EP) . |
| 6-151002 | 5/1994 | (JP) . |
| 7-240247 | 9/1995 | (JP) . |
| 8-287991 | 11/1996 | (JP) . |
| 10-149855 | 6/1998 | (JP) . |

* cited by examiner

*Primary Examiner*—Gary Paumen
*Assistant Examiner*—Alexander Gilman
(74) *Attorney, Agent, or Firm*—Anthony J. Casella; Gerald E. Hespos

(57) ABSTRACT

A connector is provided which can prevent a terminal fitting from finely sliding in a cavity when an external force acts on a wire drawn out from the connector. The connector includes a housing 3 formed with cavities 9 for accommodating terminal fittings 2. A pair of retainers 4 are mounted on the upper and lower sides of the housing 3 to doubly lock the terminal fittings 2. Each retainer 4 is provided with wire fixing portions 23 in addition to locking pieces 22 for locking the terminal fittings 2. On the other hand, an inner wall surface 11 of each cavity 9 is formed with a recess as a wire bending portion 12. When the retainers 4 are mounted after the terminal fittings 2 connected with ends of wires W are mounted into the cavity 9, the wires W are squeezingly held between the wire fixing portions 23 and the wire bending portions 12 while being bent.

1 Claim, 15 Drawing Sheets

CONNECTOR

BACKGROUND OF THE INVENTION

1. Field of the Invention

The present invention relates to a connector.

2. Description of the Related Art

Connectors used in an automotive vehicle and in similar environments are subjected to vibration, and have had a problem of abrasion due to fine sliding (fretting corrosion or micromovement) between female and male terminal fittings. A prior art terminal fitting that is intended to avoid abrasion due to vibration related micromovement is identified by the numeral 102 in FIG. 20 and is disclosed further in Japanese Unexamined Patent Publication 10-149855. This prior art terminal fitting 102 is provided with a receptacle 103 to be connected with a mating terminal fitting. A surrounding element 104 loosely and moveably surrounds the receptacle 103 and a lead 105 integrally extends from the receptacle 103. A problem of fine sliding is solved by fastening the lead 105 to a barrel 106 together with a wire conductor.

However, the prior art terminal fitting 102 can not solve the problem of fine sliding completely since it is shaken in a housing 101 as shown in FIG. 21 if a wire W is shaken due to the vibration of an automotive vehicle.

The present invention was developed in view of the above problem, and an object thereof is to provide a connector which can more securely solve the problem of fine sliding.

SUMMARY OF THE INVENTION

According to the invention, there is provided a connector, comprising one or more terminal fittings connected or connectable with wires. A housing is formed with one or more cavities for at least partly accommodating the terminal fittings, and a mount member is mounted on the housing. The wires are prevented from shaking or are engaged by a wire fixing means behind the terminal fittings when the mount member is mounted on the housing. Accordingly, since the wires are held or engaged by the wire fixing portion behind the terminal fittings so as not to shake, even if the wires are subjected to vibration, this vibration does not reach the terminal fittings. Therefore, the problem of fine sliding can be solved.

According to a preferred embodiment of the invention, the mount member is a retainer to lock the terminal fittings and to prevent them from coming out of their respective cavity. Accordingly, the terminal fittings can be locked and the wires can be fixed by mounting the retainer as a mount member on the housing.

Preferably, the wire fixing means is provided on a selected one of the housings and the mount member and comprises one or more holders for holding the wires. Accordingly, the wires are held by the holders with the mount member mounted with the housing.

The wire fixing means may comprise a wire fixing portion provided on the mount member for tightly holding the wires in cooperation with corresponding inner wall surfaces of the cavities. Accordingly, the wires are squeezed between the wire fixing portion and the inner wall surfaces of the cavities. Thus, even if the wires are subjected to vibration, this vibration does not reach the terminal fittings.

A wire bending portion preferably is provided for receiving and bending the wire when the wire is tightly held by the wire fixing portion. The wire bending portion may be formed in the inner wall surface of each cavity. Accordingly, the wires are squeezed between the wire fixing portion and the inner wall surfaces of the cavities and, at the same time, are forcibly bent by the wire bending portions. Thus, the wires can be pushed more stably.

Still further preferably, the wire fixing means can substantially elastically fix the wires. Accordingly, since the wire fixing means can elastically fix the wires, the wires are held stably even if the outer diameters of the wires to be connected with the terminal fittings vary.

Most preferably, the mount member comprises a rear wall which substantially faces the rear end surface of the housing, and substantially in close contact therewith. The wire fixing portion preferably is provided in a position of this rear wall facing rear openings of the cavities in the rear end surface of the housing, and can push the wires against the edges of the rear openings of the cavities by being displaced in a direction crossing the longitudinal axes of the wires as the mount member is mounted on the housing.

It should be noted that "direction crossing the longitudinal axes of the wires" may vertically or transversely cross the longitudinal axes of the wires.

Accordingly, the wires are displaced by the wire fixing portion in the direction crossing the longitudinal axes of the wires as the mount member is mounted on the housing. Thus, the wires are pushed against the opening edges of the exits of the cavities, thereby preventing the terminal fittings from shaking.

These and other objects, features and advantages of the present invention will become more apparent upon a reading of the following detailed description and accompanying drawings.

DETAILED DESCRIPTION OF THE PREFERRED EMBODIMENT

Figure 1:
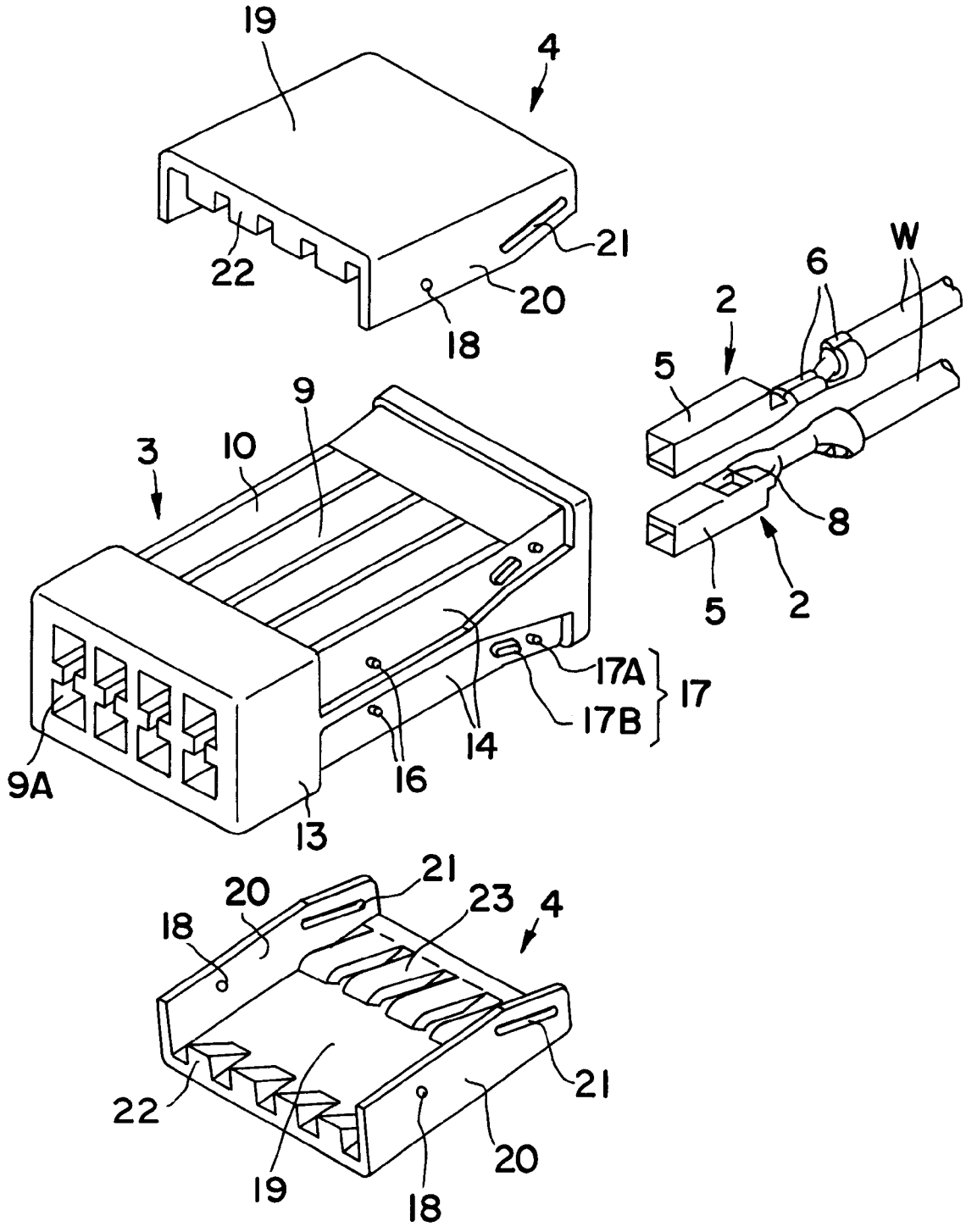
FIG. 1 is an exploded perspective view of a connector according to a first embodiment.

A connector according to this embodiment is identified by the numeral 1 in FIG. 1. The connector 1 is provided with one or more terminal fittings 2 each of which is connected with one end of a wire W. A housing 3 is provided for at least partly accommodating the terminal fittings 2, and a pair of retainers 4 are to be mounted on lateral or an upper and a lower sides of the housing 3.

The terminal fitting 2 is formed e.g. by bending a conductive plate member, and is formed with a substantially box-shaped connection portion 5 for receiving a mating male terminal fitting (not shown) at its front. A barrel portion 6 is provided behind the connection portion 5 and is to be crimped to the wire W. An engaging hole 8 is formed in one surface of the connection portion 5, and is engageable with a corresponding locking portion 7 of the housing 3.

The housing 3 is integrally or unitarily formed e.g. of a synthetic resin, and cavities 9 for accommodating terminal fittings 2 are arranged preferably in two stages inside the housing 3. A small opening is formed at the front end of the cavity 9, which is the side where the connecting or reading end of the connection portion 5 of the terminal fitting 2 is to be located. The small opening functions as a terminal connection hole 9A for receiving a male terminal fitting, whereas a large rear end opening 9B is formed at the rear end of the cavity 9 into which the terminal fitting 2 is or can be inserted at least partly. Middle portions of the cavities 9 are open toward the outside of the housing 3 to form a retainer mount opening 10. The locking portions 7 project at the front end of an inner wall surface 11 which is located between the cavities 9 in the lower stage and those in the upper stage. Each locking portion 7 is elastically deformable substantially along a direction at an angle different from 0° or 180°, preferably substantially normal to the longitudinal direction of the terminal fitting 2, e.g. along the vertical direction of FIG. 2. Thus each locking portion 7 is engageable with the engaging hole 8 of the terminal fitting 2, to lock the terminal fitting 2, and to prevent the terminal fitting from coming out of the cavity 9. Further, a recess, as a wire bending portion 12, is formed in a position of the inner wall surface 11 slightly backwardly from its center. The wire W is or can be received in the wire bending portion 12 while being bent.

Retainer engaging recesses 14 are formed in the left and the right side walls 13 of the housing 3 and are used to mount or hold or position the retainer 4. The retainer engaging recesses 14 have a shape conforming to the shape of engaging pieces 20 of the retainers 4 to be described later. An engaging projection 16 is comprised of at least one protuberance and projects at the front end of each retainer engaging recess 14. Similarly, a sliding engaging portion 17 is comprised of at least two protuberances that project at the rear end of each retainer engaging recess 14. The engaging projection 16 preferably has a substantially circular cross-section and is engageable with an engaging hole 18 of the retainer 4.

Figure 4:
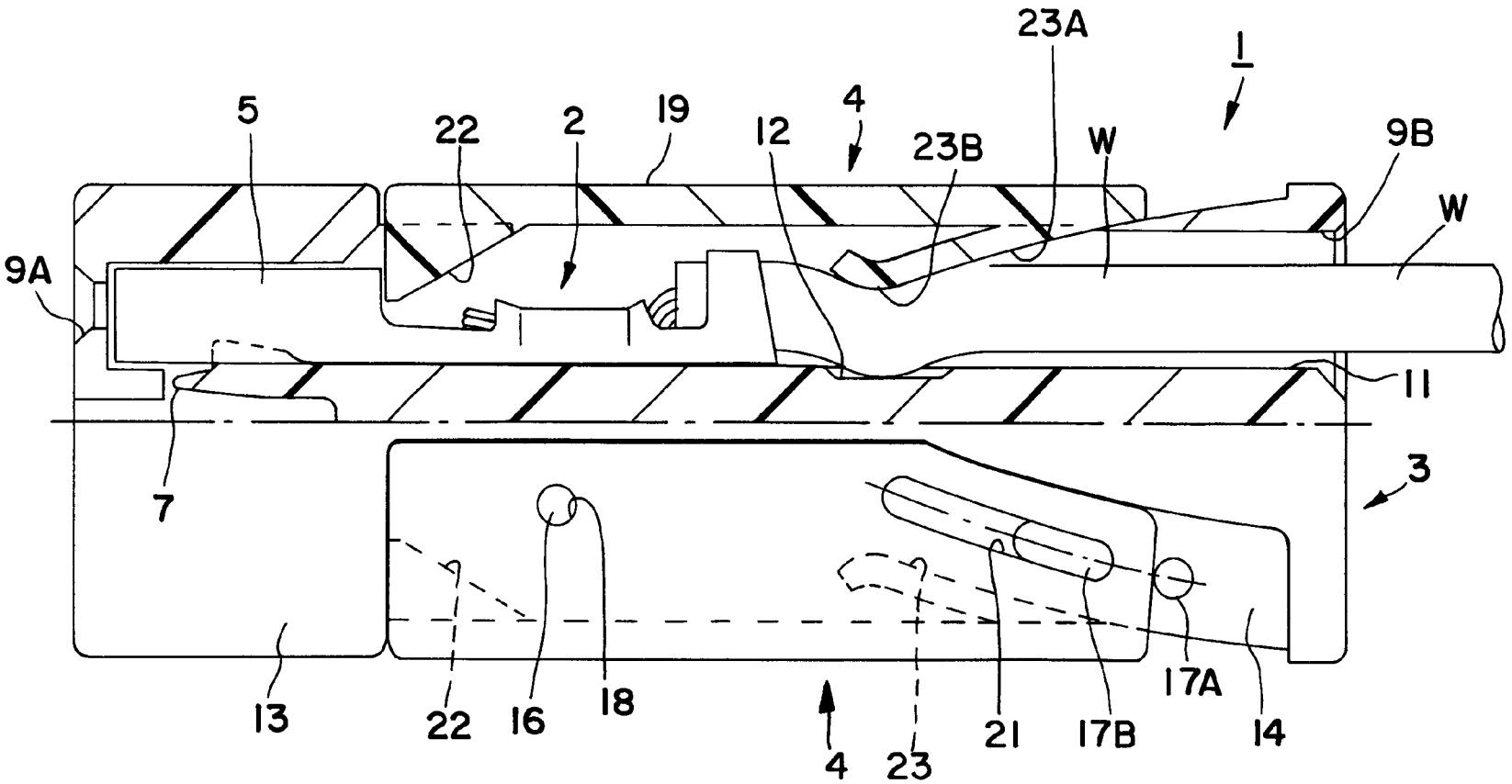
FIG. 4 is a side view of the assembled connector with its upper half shown in section.

The sliding engaging portion 17 is comprised of a second engaging projection 17A located at the rear side and a sliding guide projection 17B located at the front side. The sliding engaging portion 17 is fittable into an engaging groove 21 of the retainer 4. The second engaging projection 17A has a substantially circular cross-section. However the sliding guide projection 17B has an oblong or elongated cross-section. The sliding guide projection 17B is located more toward the inner wall surface 11 of the housing 3 than the second engaging projection 17A, and the front side thereof is inclined at an angle different from 0° or 180° toward the inner wall surface 11 (FIG. 4). Further, the entire sliding guide projection 17B is slightly curved, so that a phantom curve A can be drawn for smoothly connecting a centre line of sliding guide projections 17B and a centre of the second engaging projection 17A.

Figure 2:
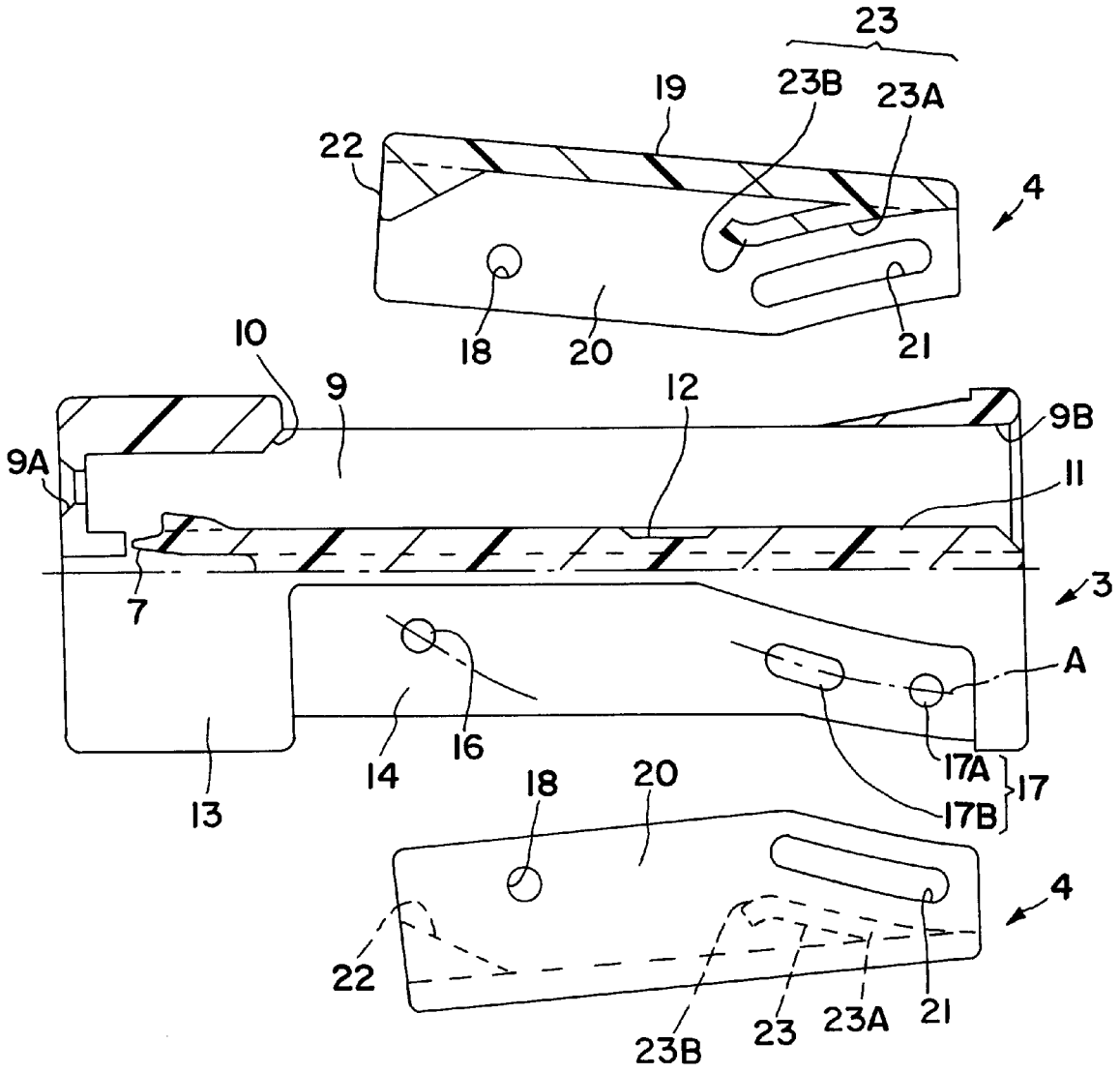
FIG. 2 is an exploded side view of the connector before a retainer is mounted on a housing with its upper half shown in section.

The pair of retainers 4 are mounted on the upper and the lower sides of the housing 3 in FIG. 2. Each retainer 4 is formed integrally or unitarily e.g. of a synthetic resin, and is comprised of a covering portion 19 for substantially covering the retainer mount opening 10 of the housing 3 and a pair of engaging pieces or parts 20 that project from the opposite lateral edges of the covering portion 19. The engaging pieces 20 are slightly deformable in directions away from each other. Projecting locking pieces 22 are provided at the leading end of the inner surface (surface to be mounted on the housing 3) of the covering portion 19 for engaging the rear ends of the connection portions 5 of the terminal fittings 2 to substantially lock the terminal fittings 2. Further, a wire fixing portion 23 projects in the vicinity of the rear end of the inner surface of the covering portion 19. The wire fixing portion 23 preferably is in the form of a cantilever having a base end 23A connected with the covering portion 19, and a leading end 23B projecting obliquely forwardly. The leading end 23B is bent slightly toward the covering portion 19, and is elastically deformable upwardly and downwardly in FIG. 2 or towards and away from a position of the wire W in the cavity 9. The leading end 23B is located in a position to face the wire bending portions 12 of the housing 3 when the retainer 4 is mounted on the housing 3.

Each engaging piece 20 is formed with an engaging hole 18 that is engageable with the corresponding engaging projection 16 of the housing 3 and an oblong engaging groove 21 having a length substantially equal to the entire length of the sliding engaging portion 17 (or a length from one end of the second engaging projection 17A to the opposed end of the sliding guide projection 17B). This engaging groove 21 is slightly curved so as to conform to the phantom curve A which could be drawn in or conforming to the sliding engaging portion 17.

Each retainer 4 is engageable with the housing 3 in two locking positions. One locking position is a partial locking position where the retainer is partly engageable with the housing 3 and the insertion and withdrawal of the terminal fittings 2 into and from the cavities 9 are permitted. The other locking position is a full locking position where the retainer is fully engaged with the housing and the insertion or withdrawal of any terminal fitting 2 is not possible. In the partial locking position, the entire sliding engaging portions 17 or both projections 17A and 17B are fitted into the engaging grooves 21 of the engaging pieces 20, and the engaging projections 16 preferably are substantially in contact with the outer edges of the engaging pieces 20 (see FIG. 3). On the other hand, in the full locking position, the second engaging projections 17A are disengaged from the engaging grooves 21 and contact the rear edges of the engaging pieces 20. In this full locking position the rear edges of the sliding guide projections 17B preferably are substantially in contact with the rear edges of the engaging grooves 21 (see FIG. 4). Additionally in this full locking position, the engaging projections 16 are fitted into the engaging holes 18 (see FIG. 4).

Figure 3:
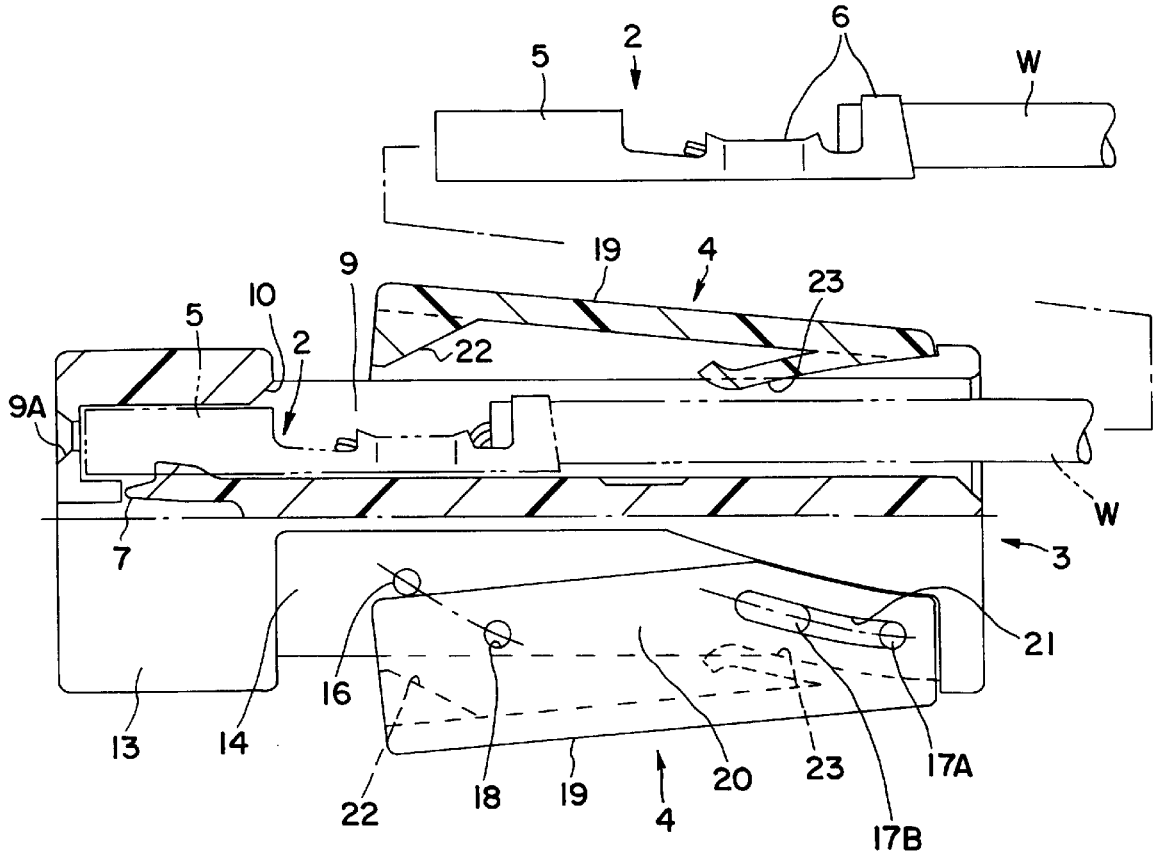
FIG. 3 is a side view of the connector when the retainer is mounted on the housing accommodating terminal fittings with its upper half shown in section.

The retainers 4 can be mounted on the housing 3 to their partial locking positions (see FIG. 3). At this time, the locking pieces 22 and the wire fixing portion 23 leave the cavities 9 open substantially along forward and backward directions so as to permit the insertion and withdrawal of the terminal fittings 2. Here, the terminal fittings 2, with the wires W connected thereto, are mounted into the cavities 9. The locking portions 7 are engaged elastically with the engaging holes 8 by the terminal fittings 2 that are pushed to their specified positions to lock the terminal fittings.

Subsequently, the retainers 4 are pushed to engage the housing 3 more deeply. The retainers 4 are pushed while being guided by the engagement of the sliding engaging portions 17 and the engaging groove 21. Thus, the engaging projections 16 and the engaging pieces 20 are brought into contact with each other, and the opposite engaging pieces 20 are mounted while being slightly elastically deformed in directions away from each other or away from the engaging projection 16. Then, the engaging projections 16 are fitted into the engaging holes 18, and the engaging pieces 20 preferably are restored substantially to their original shape, with the result that the retainers 4 are mounted in their full locking positions. In this way, the assembling of the connector 1 is completed. At this time, the locking portion 22 is located behind the rear end of the connection portion 5 of the terminal fitting 2 in each cavity 9 to lock the terminal fitting 2 doubly. Behind the terminal fitting 2, the wire fixing portion 23 pushes the wire W against the inner wall surface 11 while being slightly elastically deformed. As a result the wire W is pushed into the wire bending portion 12 and is slightly bent (see FIG. 4).

As described above, the wire W preferably is held tightly between the wire fixing portion 23 and the inner wall surface 11 of the cavity 9 in this embodiment. Accordingly, even if the vibration of a vehicle acts on the wire W, this vibration does not reach the terminal fitting 2 by being blocked by the above tightly held portion, thereby preventing the terminal fitting 2 from shaking in the cavity 9.

Further, the wire fixing portion 23 can press the wire W elastically. Thus, the wire W can be fixed even if the outer diameters of the wire W to be connected with the terminal fitting 2 vary.

This is particularly effective in the case that different kinds of wires W having different outer diameters are used. In other words, the wires W preferably can be fixed elastically by the same retainers 4 even if the outer diameters of the wires W differ.

In addition, the wire W is bent by the wire bending portion 12 when being tightly held between the wire fixing portion 23 and the inner wall surface 11 of the cavity 9. Thus, the wire W can be held stably by this bent portion even if an external force acts on the wire W from the outside of the connector 1.

Other embodiments of the invention are described with reference to FIGS. 5–19. Structural elements with the same or similar construction as the first embodiment are not described in this description of the other embodiments, but are identified by the same reference numerals.

Figure 5:
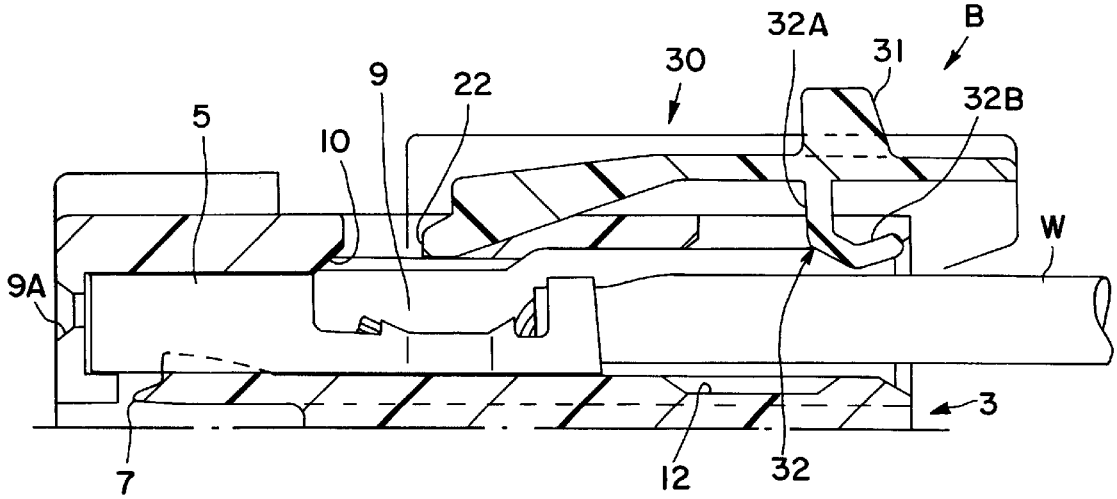
FIG. 5 is a side view in section of a connector according to a second embodiment before a retainer is mounted on a housing.
Figure 6:
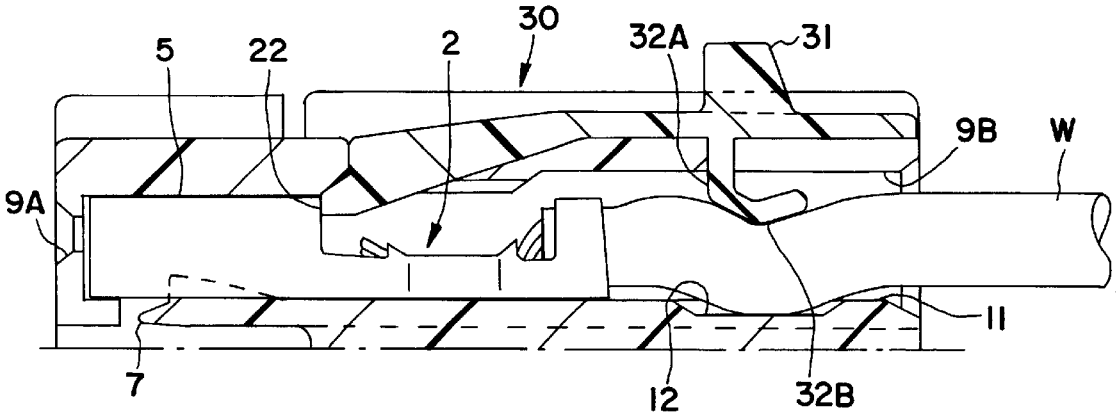
FIG. 6 is a side view in section of the assembled connector.

The second embodiment is illustrated in FIGS. 5 and 6. A main difference between the second and first embodiments lies in the construction of the retainers 30. A pressing portion 31 projects from the outer surface of the covering portion 19 to improve an operability particularly when the retainers 30 are pushed from their partial locking positions to their full locking position (a pressing direction is indicated by an arrow B in FIG. 5). Further, a wire fixing portion 32 projects in the vicinity of the rear end of the inner surface of the covering portion 19. This wire fixing portion 32 is comprised of a base portion 32A that extends downwardly from the covering portion 19 preferably substantially at right angles and a pushing portion 32B that extends backwardly from the leading end of the base portion 32A. The entire wire fixing portion 32 preferably is substantially elastically deformable, and the pushing portion 32B can push the wire W against the inner wall surface 11 and/or in the wire bending portion 12.

The same action and effects as the first embodiment can be obtained by the second embodiment constructed as above.

A third embodiment of the present invention is described with reference to FIGS. 7 and 8. In the third embodiment, a retainer 35 is mounted into the housing 3 in substantially vertical direction of FIG. 7. Although not shown in detail, the retainer 35 is in the form of a lattice, and is formed with through holes 36 for permitting the passage of the terminal fittings 2 along the transverse direction of FIG. 7. Further, a wire fixing portion 38, that has a construction similar to that of the wire fixing portion 32 shown in the second embodiment, projects from the lateral or upper wall surface 37 of each through hole 36.

Figure 7:
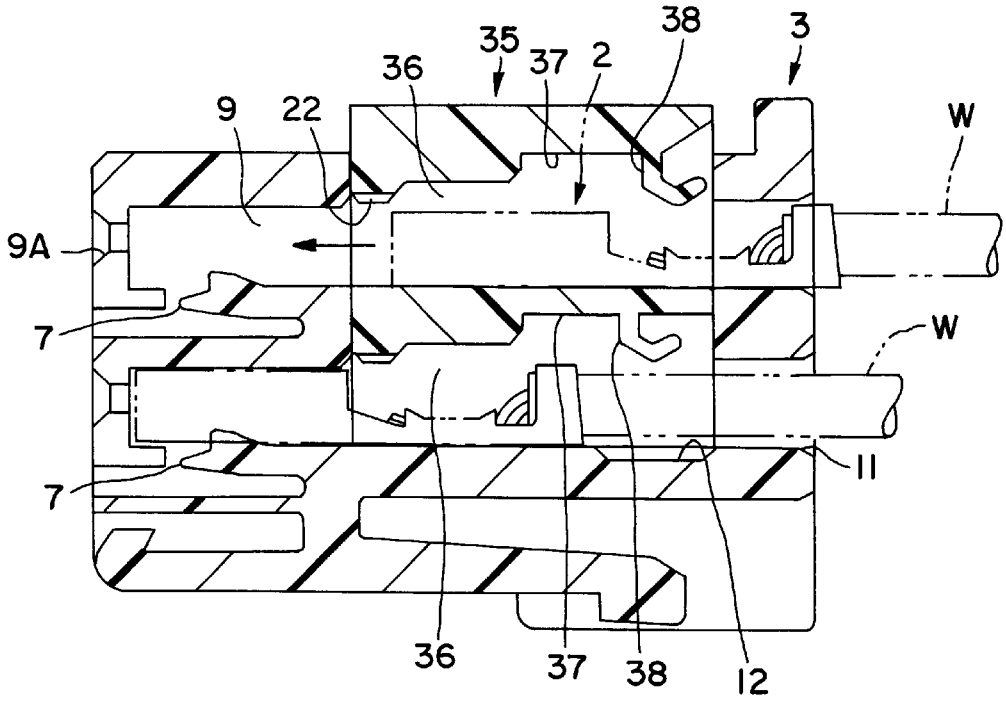
FIG. 7 is a side view in section of a connector according to a third embodiment before a retainer is mounted on the housing.
Figure 8:
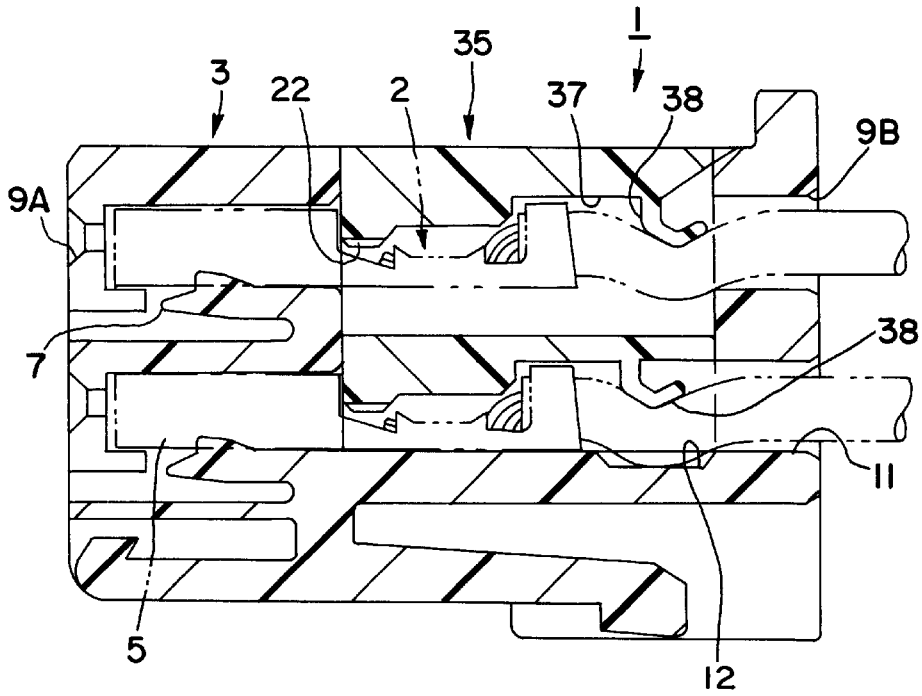
FIG. 8 is a side view in section of the assembled connector.

The retainer 35 is engageable with the housing 3 in two locking position, namely, a partial locking position, as shown in FIG. 7, and a full locking position, as shown in FIG. 8. In the partial locking position, the through holes 36 leave the cavities 9 substantially open to permit the insertion and the withdrawal of the terminal fittings 2. On the other hand, the locking pieces 22 and the wire fixing portions 38 of the retainer 35 enter the cavities 9 to prevent the insertion and withdrawal of the terminal fittings 2.

The same action and effects of the fourth embodiment can be obtained by the third embodiment constructed as above.

Figure 9:
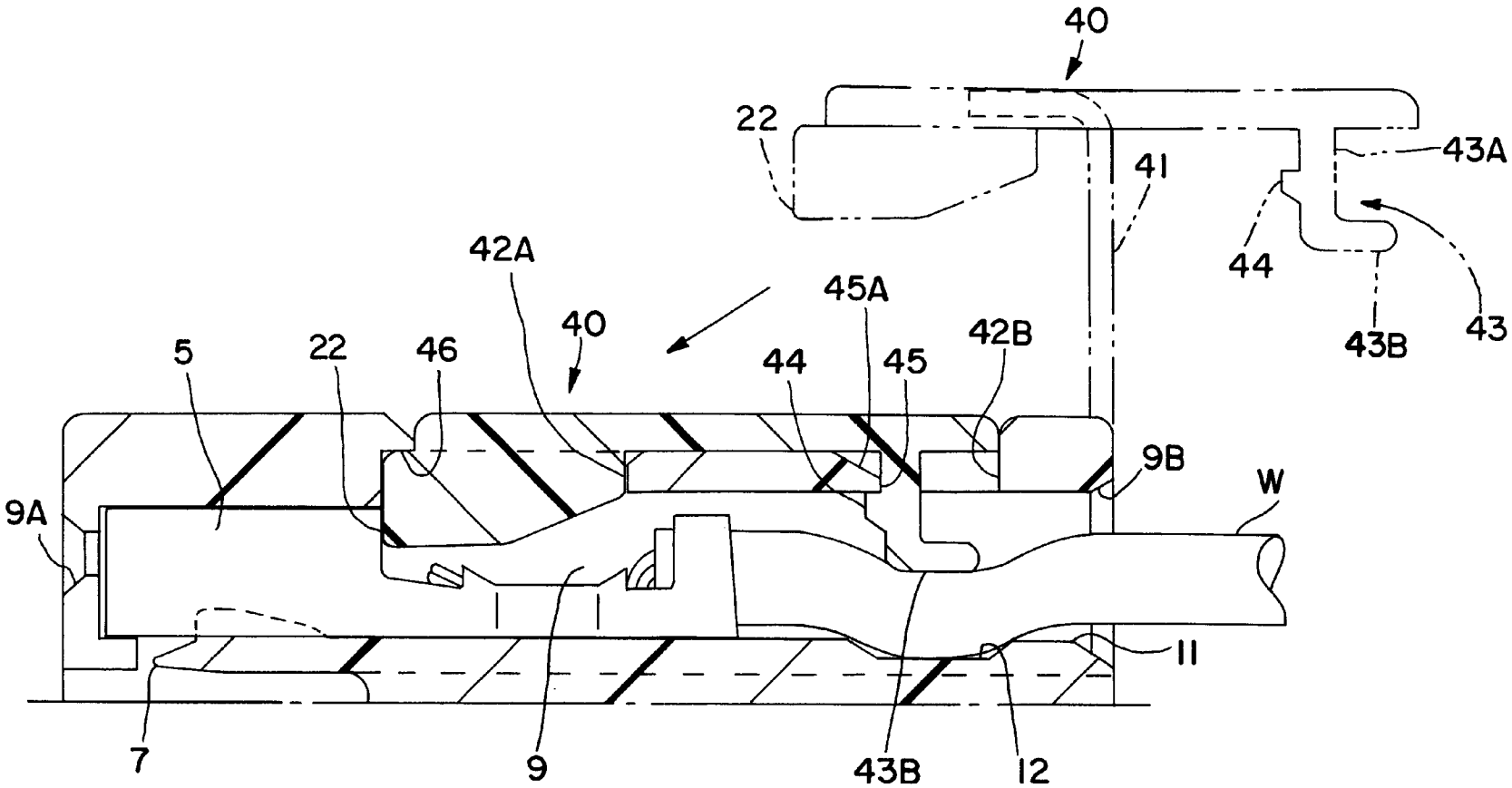
FIG. 9 is a side view in section of a connector according to a fourth embodiment with a retainer before mounting shown in phantom line.
Figure 10:
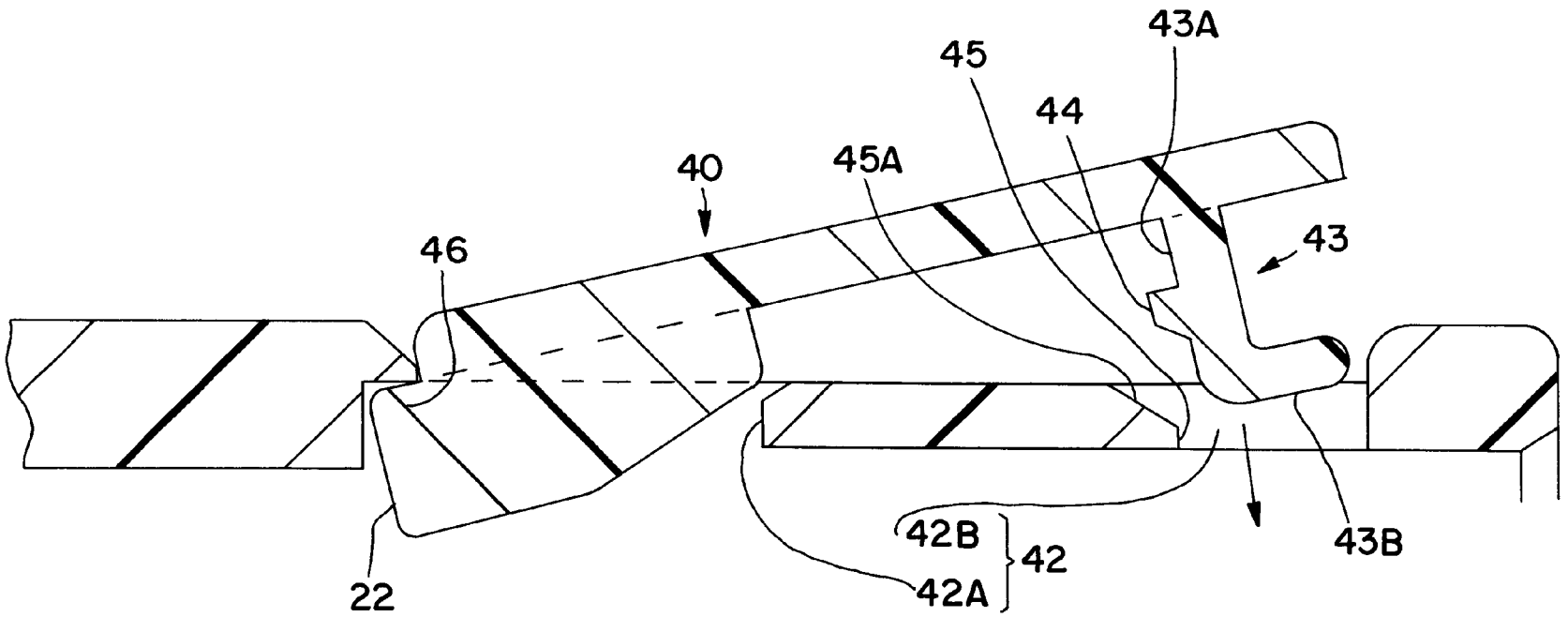
FIG. 10 is a side view in section showing the operation of mounting the retainer.
Figure 11:
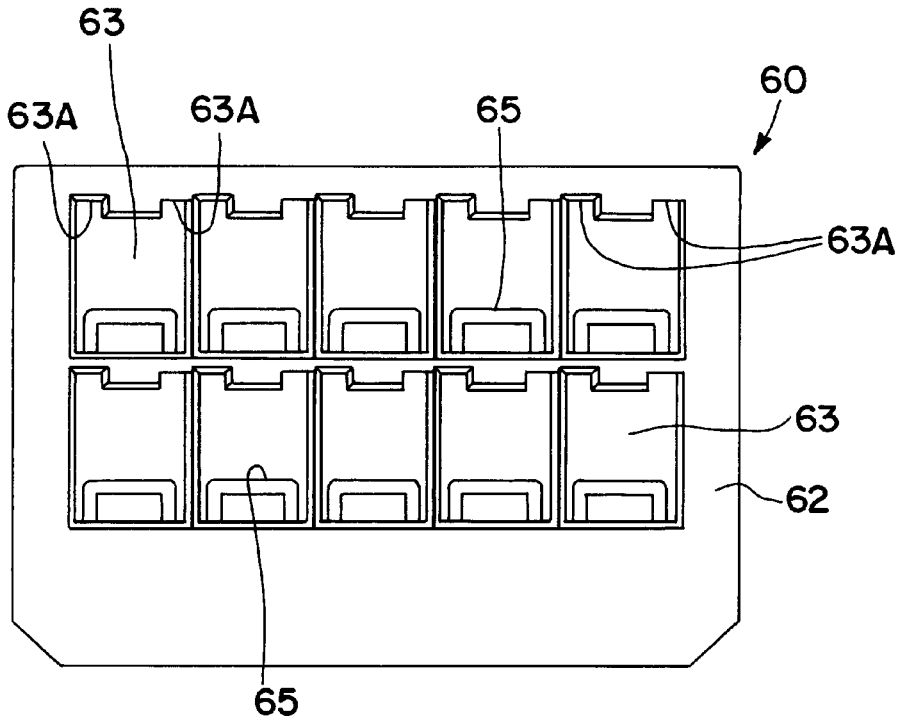
FIG. 11 is a rear view of a retainer according to a fifth embodiment.

A fourth embodiment of the invention is described with reference to FIGS. 9 and 10. In the fourth embodiment, retainers 40 are connected or connectable with the housing 3 by hinges 41. Because of the presence of the hinges 41, the retainers 40 can be carried together with the housing 3 even before they are mounted on the housing 3. Each retainer 40 is substantially in the shape of a flat plate, and locking pieces 22 for locking the terminal fittings 2 project at the left end of the lower surface of the retainer 40 in FIG. 9. Further, a wire fixing portion 43 projects downwardly in vicinity of the right end of the lower surface of the retainer 40.

The wire fixing portion 43 is comprised of a base portion 43A and a pushing portion 43B. The base portion 43A extends downwardly from the lower surface of the retainer 40 substantially at an angle different from 0° or 180°, preferably substantially at right angles. The pushing portion 43B extends preferably backwardly from the leading end of the base portion 43A. Further, the entire wire fixing portion 43 is formed to be elastically deformable, and the pushing portion 43B can push the wire W against the inner wall surface 11 and/or into the wire bending portion 12. Further, an engaging piece 44 projects in the middle of the front surface of the base portion 43A. This engaging piece 44 is engaged with an engaging edge 45 of the housing 3 to lock the retainer 40 and the housing 3 into each other.

A retainer mount opening 42 of the housing 3 preferably is comprised of a pair of holes located at front and rear sides. The locking pieces 22 of the retainer 40 is mounted into a locking piece mount opening 42A at the front side, and a wire fixing portion 43 of the retainer 40 is mounted into the fixing portion mount opening 42B at the rear side. A front end of the opening edge of the locking piece mount opening 42A serves as a front engaging edge 46, with which the upper edge of the locking pieces 22 are engageable. Further, the front end of the opening edge of the fixing portion mount hole 42B serves as a rear engaging edge 45, with which the engaging piece 44 of the retainer 40 is engageable. A guide surface 45A is formed in a corner portion of the rear engaging edge 45 to guide the engagement with the engaging piece 44.

The retainer 40 is mounted on the housing 3 as follows. First, the locking pieces 22 are inserted into the locking piece mount opening 42A to lightly engage the front ends of the locking pieces 22 with the front engaging edge 46 (see FIG. 10). In this state, the locking pieces 22 are not sufficiently located in the cavities 9 so as to permit the insertion and withdrawal of the terminal fittings 2. At this stage, the terminal fittings 2 connected with the wires w are mounted into the cavities 9, and the wire fixing portion 43 is inserted into the fixing portion mount opening 42B by pushing the rear part of the retainer 40 toward the housing 3. The wire fixing portion 43 is inserted while the base portion 43A thereof is deformed slidably and elastically in a backward direction by the contact of the engaging piece 44 and the engaging edge 45, and is restored preferably substantially to its original shape when the engaging piece 44 moves over the engaging edge 45. In this way, the mounting of the retainer 40 is completed.

The same action and effects as the first embodiment can also be obtained by the fourth embodiment.

Figure 12:
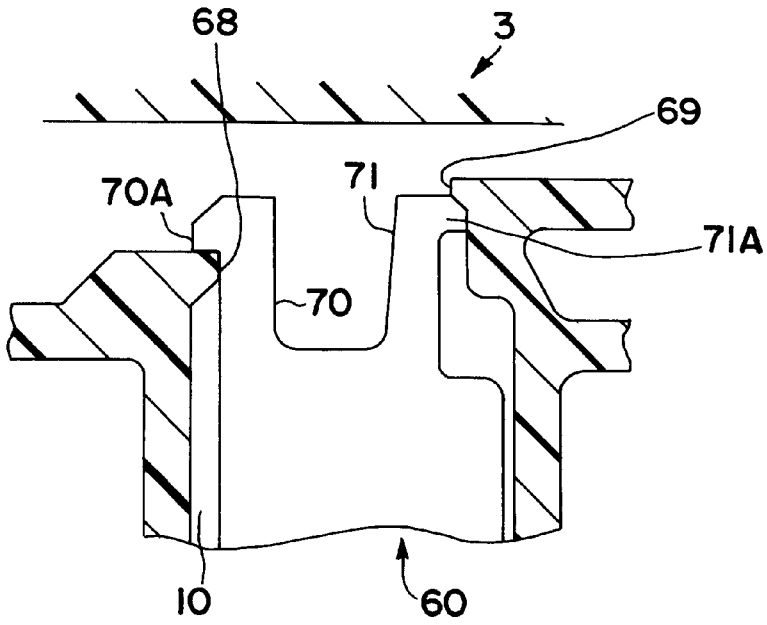
FIG. 12 is a side view in section showing the engagement of the retainer with a housing in its partial locking position.
Figure 13:
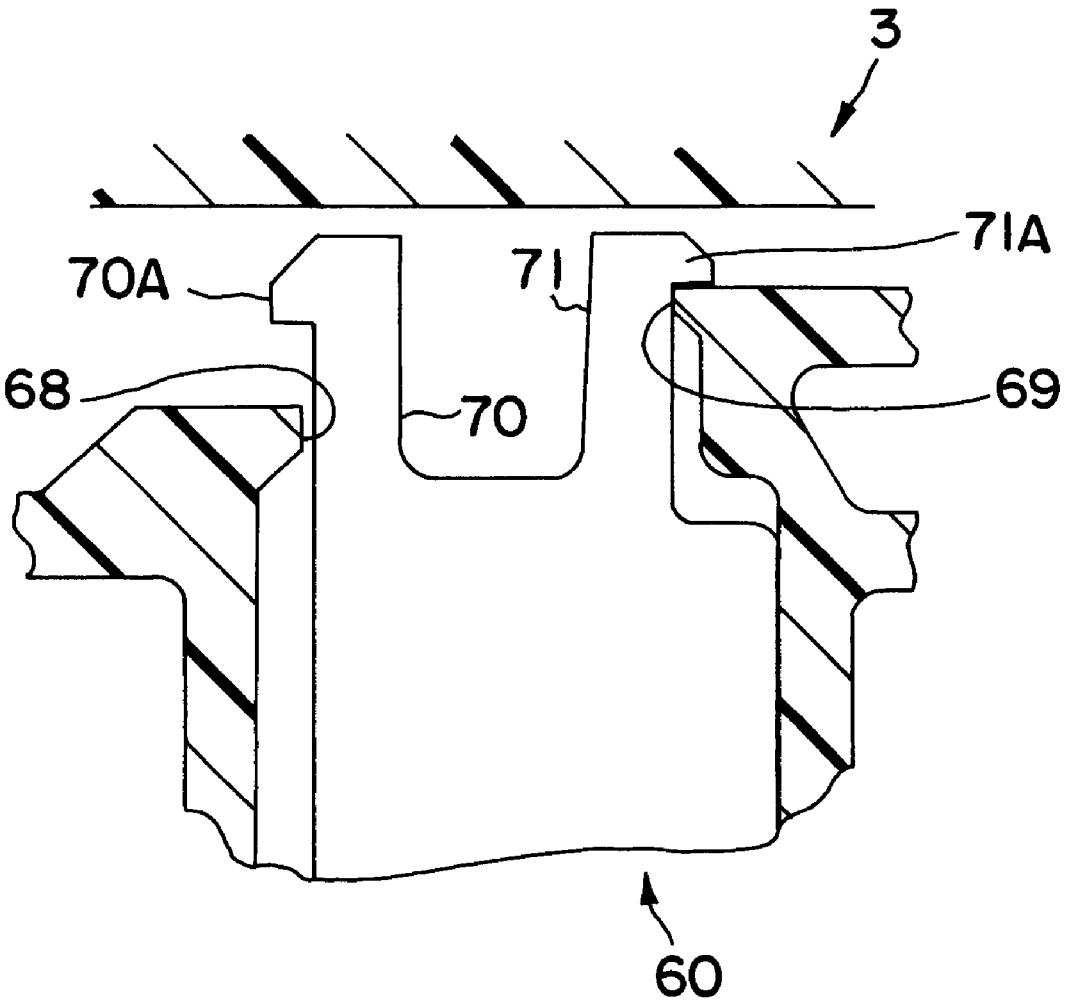
FIG. 13 is a side view in section showing the engagement of the retainer with the housing in its full locking position.

Next, a fifth embodiment of the invention is described in detail with reference to FIGS. 11 to 18. The housing 3 and the retainer 60 of the fifth embodiment are engageable in two positions, namely a partial locking position where the housing 3 and the retainer 60 are partly engaged and a full locking position where they are fully engaged. A retainer mount opening 10 is formed substantially in the middle of the bottom wall of the housing 3 to expose middle portions of the respective cavities 9 to the outside. At the opposite lateral sides of the retainer mount opening 10, a pair of engaging projections 68, 69 are formed to face each other at the front and rear side as shown in FIGS. 12 and 13.

Partial engaging projections 68 at the front side are located lower than a full engaging projection 69 at the rear side. On the other hand, a pair of engaging legs 70, 71 located at the front and rear sides project in such a manner as to be substantially elastically deformable at the opposite lateral sides of the retainer 60. The engaging projections or hooks 70A, 71A are engageable with the engaging projections 68, 69 of the housing 3 and project at the leading ends of the engaging legs 70, 71. In other words, the housing 3 and the retainer 60 are engaged in their partial locking position by the engagement of the partial engaging hook 70A of the partial engaging leg 70 at the front side with the partial engaging projection 68 (see FIG. 12), whereas the housing 3 and the retainer 60 are engaged in their full locking position by the engagement of the full engaging projection or hook 71A of the full engaging leg 71 at the rear side with the full engaging projection 69 (see FIG. 13).

Figure 14:
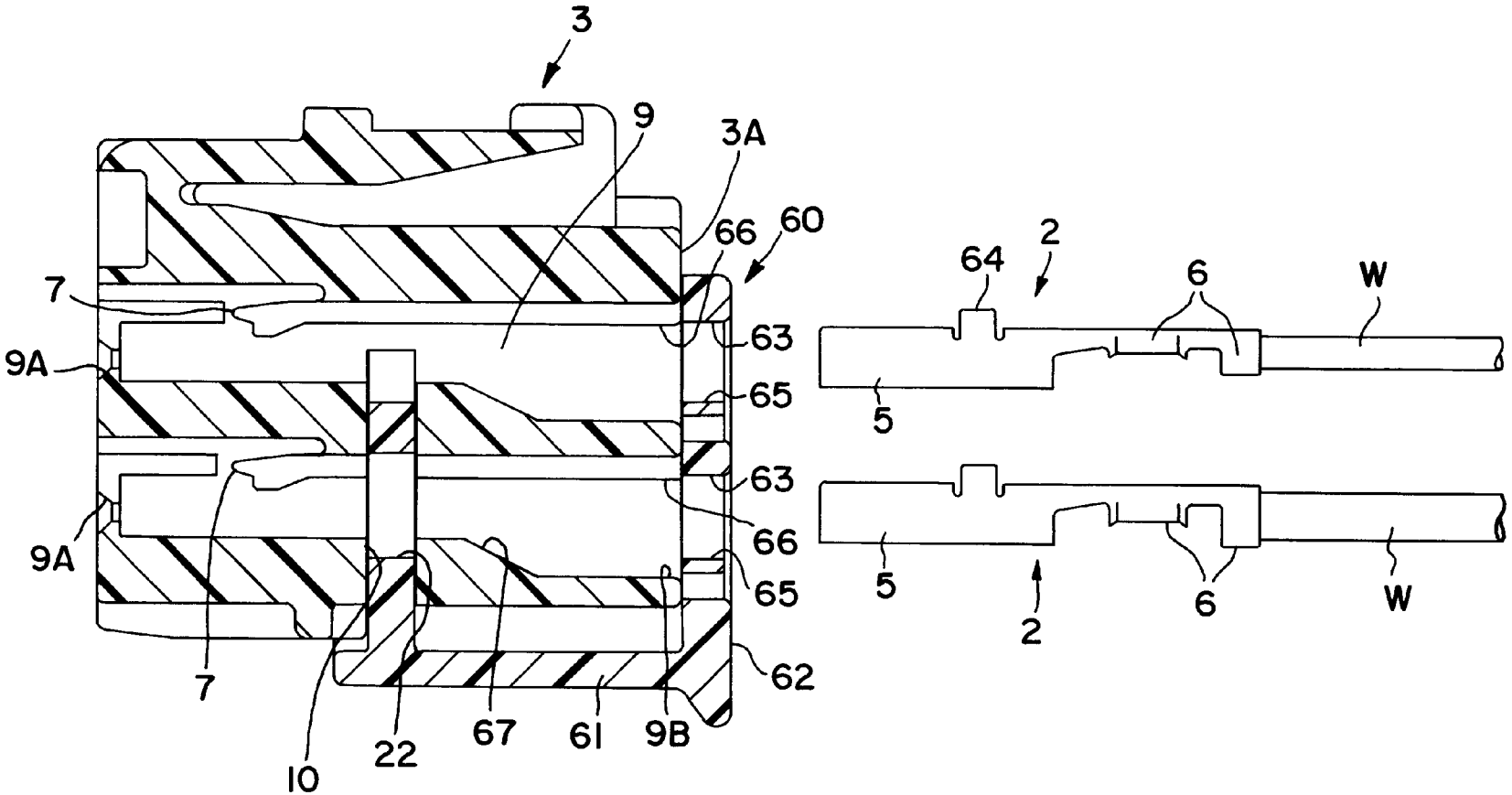
FIG. 14 is a side view in section showing a state before terminal fittings are mounted into the housing with the retainer partly locked.

Further, as shown in FIG. 14, a guide surface 67 is slanted downward at the rear part of the bottom surface of the cavity 9. Thus, if the leading end of the terminal fitting 2 is oriented excessively downwardly when the terminal fitting 2 is inserted into the cavity 9, this leading end is guided to a proper insertion direction by the guide surface 67.

The retainer 60 is mounted into the housing 3 preferably from below. Locking pieces 22 project upwardly from a bottom wall 61 of the retainer 60 in the vicinity of the leading end thereof and are mounted into the retainer mount hole 10 of the housing 3. Further, a rear wall 62 is provided on the rear edge of the bottom wall 61. The rear wall is opposed to and substantially in close contact with a rear end surface 3A of the housing 3. Wire insertion holes 63 that preferably have a substantially rectangular cross section penetrate through the rear wall 62 along forward and backward directions in positions corresponding to the cavities 9. Grooves 63A are formed at the upper left and right ends of each wire insertion hole 63 for permitting the passage of a pair of stabilizers 64 projecting from the upper surface of the terminal fitting 2. A substantially arch-shaped wire fixing portion 65 is provided at the bottom end of each wire insertion hole 63. The arch shaped wire fixing portion 65 has its left and right portions connected with the bottom surface of the wire insertion hole 63. This wire fixing portion 65 is substantially elastically deformable downwardly.

Figure 15:
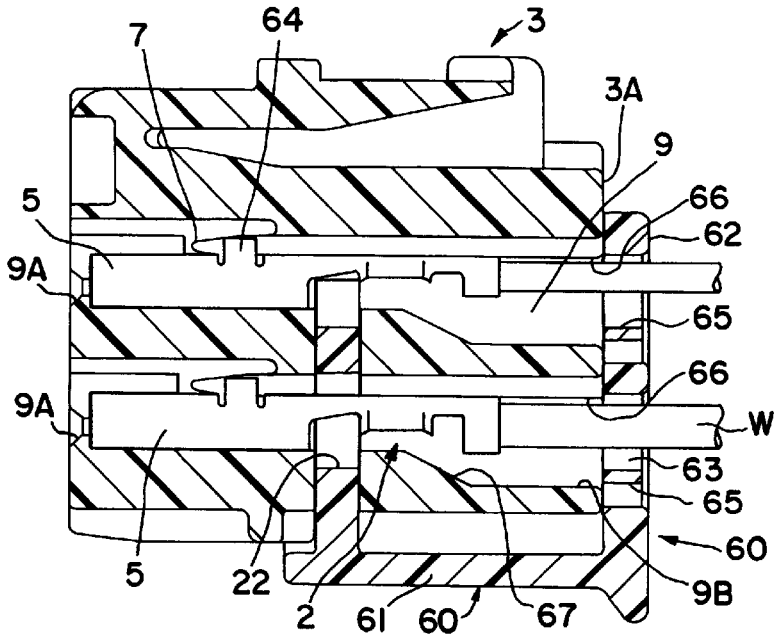
FIG. 15 is a side view in section showing a state when the terminal fittings are mounted in the housing with the retainer partly locked.
Figure 16:
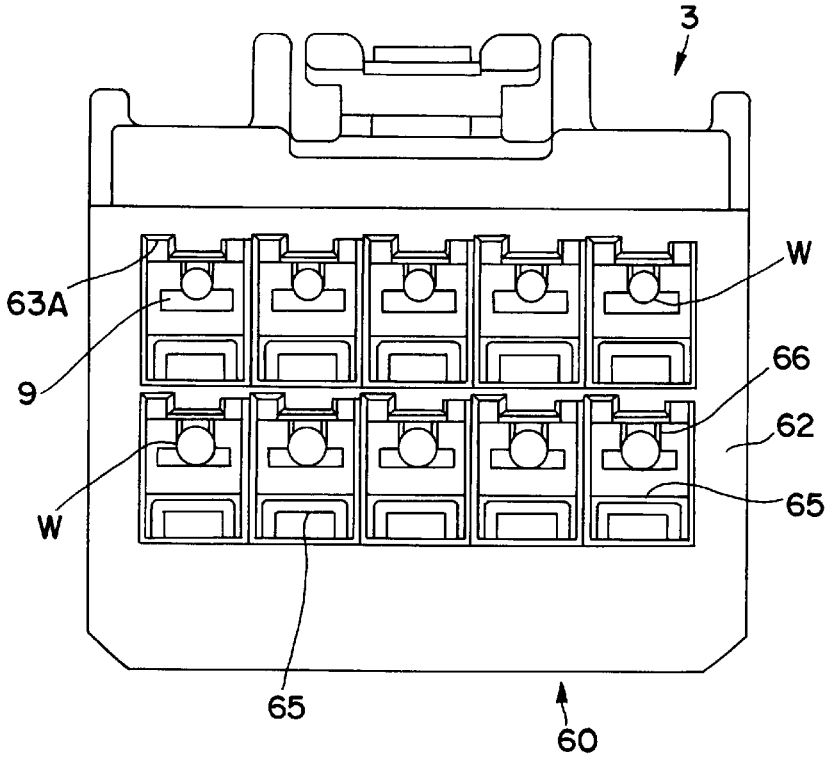
FIG. 16 is a rear view showing a state when the terminal fittings are mounted in the housing with the retainer partially locked.
Figure 17:
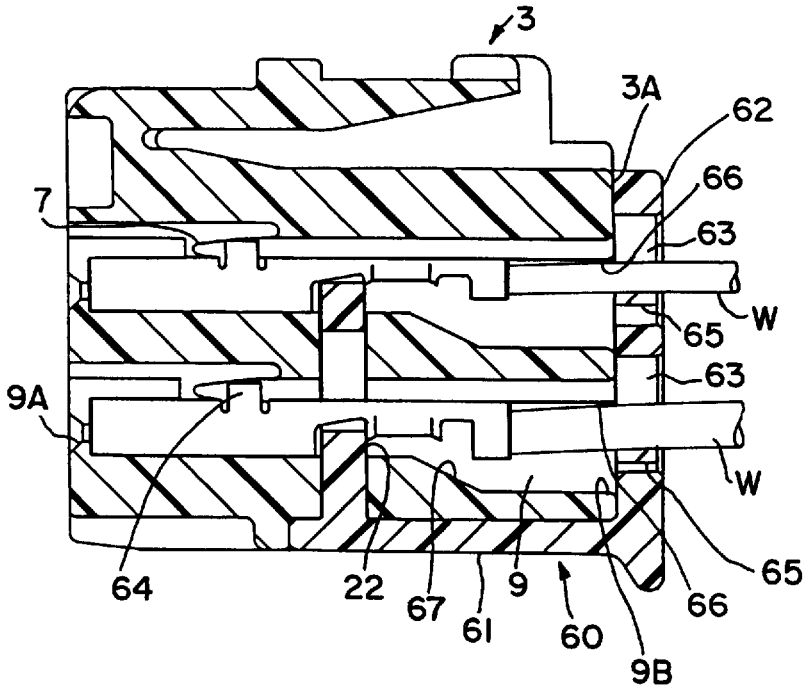
FIG. 17 is a side view in section of the completely assembled connector.
Figure 18:
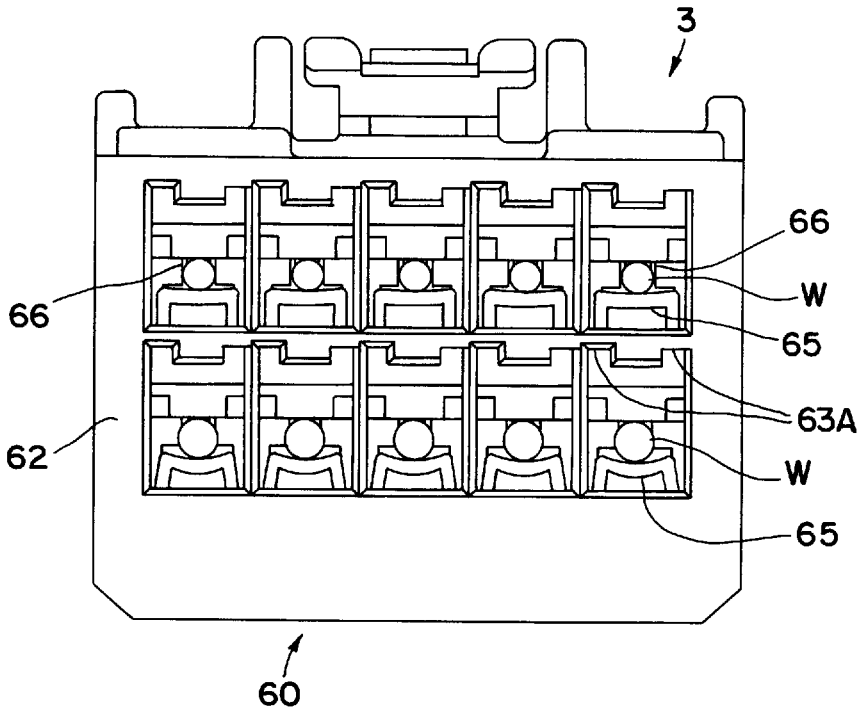
FIG. 18 is a rear view of the completely assembled connector.

As shown in FIGS. 14 to 16, the wire fixing portions 65 are retracted to the vicinity of the bottom ends of the cavities 9 and the locking pieces 22 do not project into the cavities 9 when the retainer 60 is in its partial locking position. Accordingly, the terminal fittings 2 can be inserted into the corresponding cavities 9. On the other hand, the locking pieces 22 enter the cavities 9 to engage and lock the terminal fittings 2 as shown in FIGS. 17 and 18 when the retainer 60 is pushed to its full locking position.

At this time, as the retainer 60 is mounted into the housing 3, the wire fixing portions 65 are displaced in a direction crossing the longitudinal axes of the wire W, thereby pushing the wires W against the opening edges 66 of the rear end openings 9B of the cavities 9. As a result, the terminal fittings 2 are prevented from shaking.

As described above, the same action and effects as the fourth embodiment can also be obtained by the fifth embodiment.

Further, in the fifth embodiment, the wires W are fixed by being tightly held between the opening edges 66 of the cavities 9 and the retainer 60. Therefore, the dimension of the housing 3 along forward and backward directions can be shortened as compared with the case where the wires W are fixed in the cavities 9.

Figure 19:
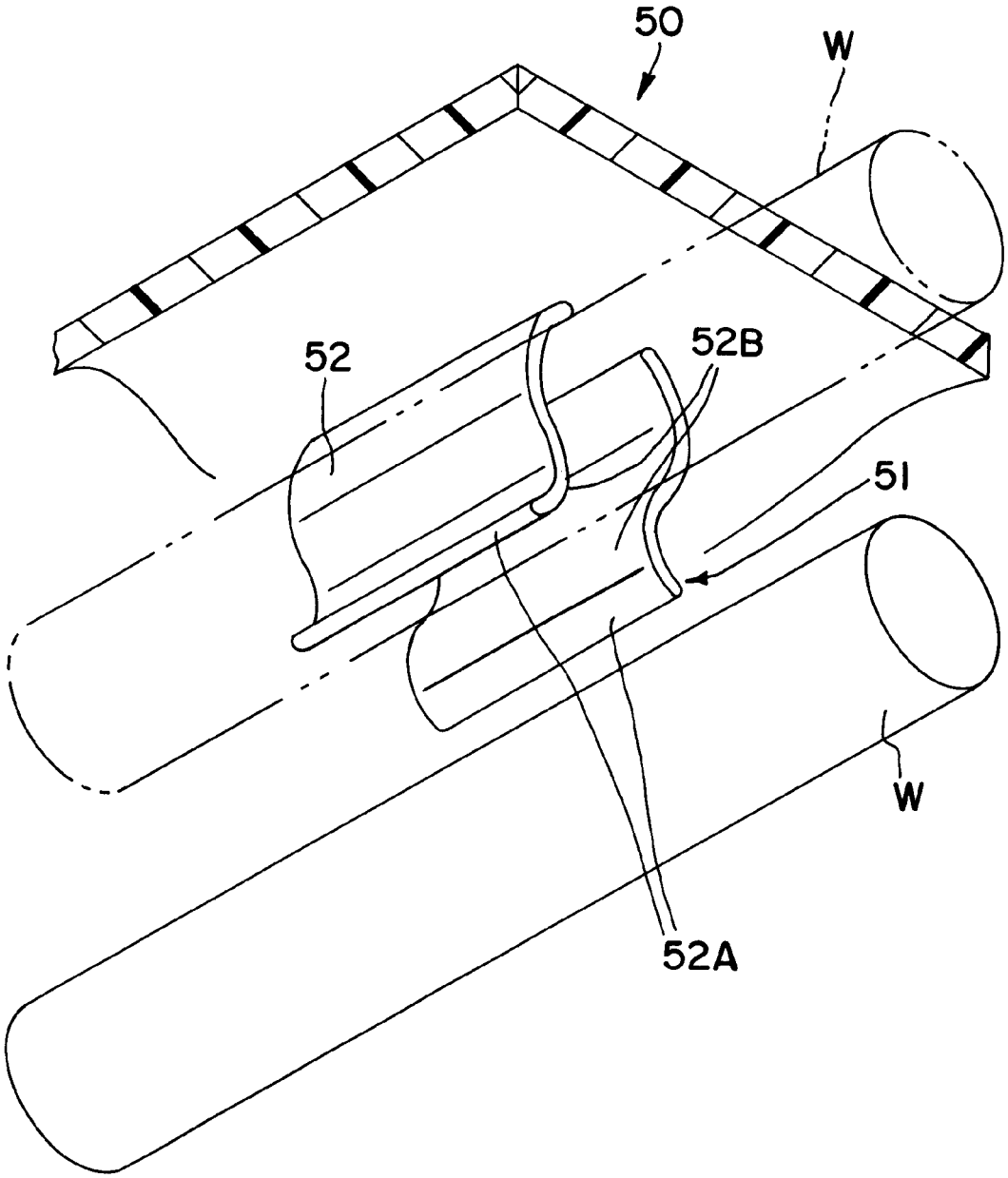
FIG. 19 is an enlarged perspective view showing a portion for fixing a wire according to an other embodiment.
Figure 20:
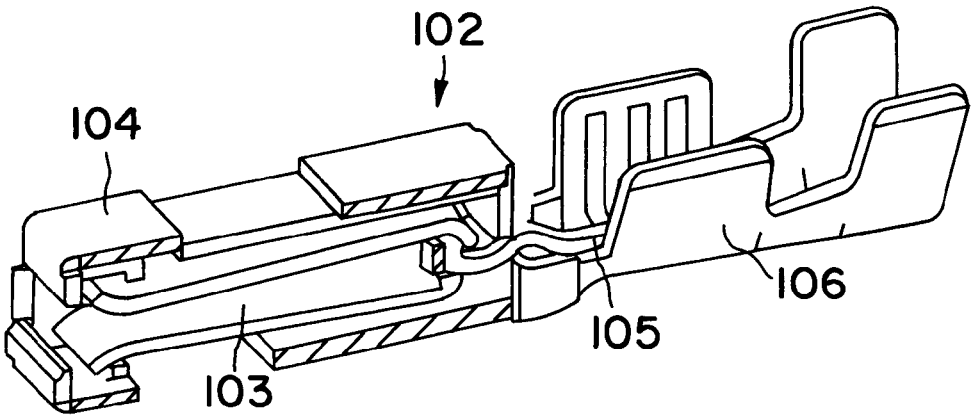
FIG. 20 PRIOR ART
FIG. 20 is a perspective view partly in section of a prior art terminal fitting.
Figure 21:
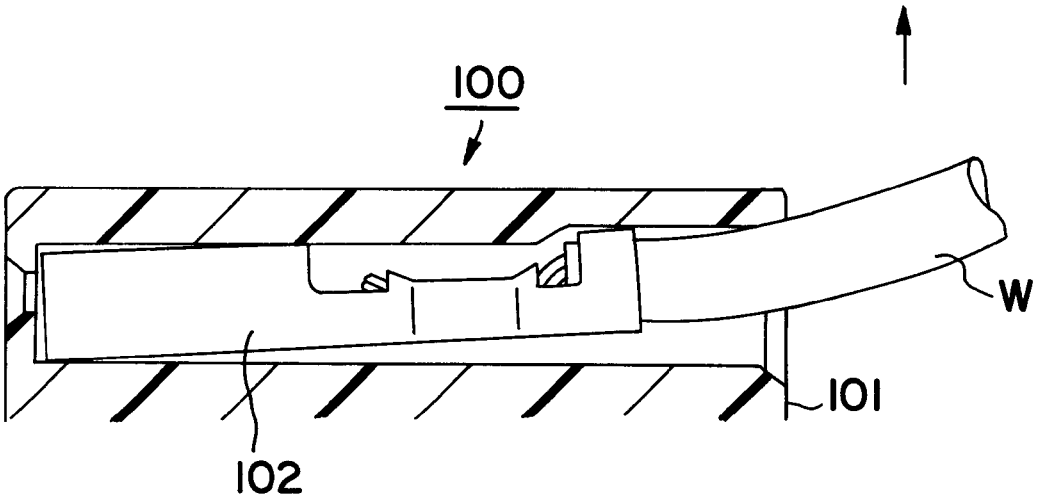
FIG. 21 PRIOR ART
FIG. 21 is a side view in section of a connector when the prior art terminal fitting is mounted in a generally used housing.

FIG. 19 shows another embodiment of the present invention in which holders 51 are provided on the rear surface (surface to be mounted on the housing) of the retainer 50 for fixing the wires W. The holder 51 fixes the wire W by elastically tightly holding it from opposite sides. The holder 51 is comprised of a pair of elastic holding pieces 52 substantially symmetrically provided on the left and right sides of the wire W. Each elastic holding piece 52 preferably has a substantially s-shaped cross section and is substantially elastically deformable. Portions of the elastic holding pieces 52 near the opening edges 52A are curved outwardly to enlarge a spacing between the opening edges 52A and to facilitate the pushing of the wire W between the elastic holding pieces.

The elastic holding pieces 52 approach each other in portions located more toward the base (toward the retainer 50) than the opening edges 52A, thereby forming waist portions 52B. A spacing between the waist portions 52B is set smaller than the outer diameter of the wire W. Further, the inner diameter of the holder 51 is set slightly smaller than the outer diameter of the wire W so as to hold the wire W with a specified contact pressure (see the position of the wire W shown by phantom line). The fine sliding of the wire W can be suppressed by the holder 51 constructed as above. Although the holder 51 is provided on the retainer in this embodiment, it may be provided on the housing.

The present invention is not limited to the foregoing embodiments. For example, embodiments below are also embraced by the technical scope of the present invention as defined in the claims.

Although only the female connectors for accommodating the female terminal fittings are shown in the first to fourth embodiments, the invention is also applicable to male connectors for accommodating male terminal fittings.

In the respective foregoing embodiments are shown side-type connectors in which the retainer is mounted sideways (a direction substantially normal to the direction in which the terminal fittings are mounted) with respect to the housing. The invention is also applicable to rear-type connectors in which the retainer is mounted on the housing from behind (side where the terminal fittings are mounted).

According to the invention, the wire bending portion are not necessarily provided. The wires may be only squeezed between the wire fixing portion and the inner wall surface by forming the inner wall surface of the housing flat.

Although only the retainers are provided as a mount member to be mounted on the housing in the foregoing embodiments, the mount member is not limited to the retainer according to the invention. For example, the mount member may be a lid for covering the cavities exposed to the outside or a cover to be mounted on the housing.

Although the wire fixing means elastically fixes the wires in the respective foregoing embodiments, it may not necessarily elastically fix the wires according to the invention.

What is claimed is:

1. A connector comprising:

at least one terminal fitting connected respectively with at least one wire;

a housing formed with at least one cavity for at least partly accommodating the terminal fitting, the cavity having at least one inner wall surface; and a mount member mountable on the housing and comprising a retainer portion configured for locking the terminal fitting and preventing the terminal fitting from coming out of the respective cavity, the mount member further comprising a wire fixing portion disposed behind the terminal fitting when the mount member is mounted on the housing for substantially preventing the wire from shaking, the wiring fixing portion being configured for tightly holding the wire in cooperation with the inner wall surface of the cavity, the mount member comprises a rear wall which substantially faces a rear end surface of the housing substantially in close contact therewith, the wire fixing portion being provided in a position on the rear wall facing rear openings of the cavities in the rear end surface of the housing, and being configured to push the wire against an edge of the rear opening of the cavity by being displaced in a direction crossing a longitudinal axis of the wire as the mount member is mounted on the housing.

* * * * *